US012006485B2

(12) United States Patent
Iino et al.

(10) Patent No.: US 12,006,485 B2
(45) Date of Patent: Jun. 11, 2024

(54) LUBRICATING OIL ADDITIVE AND LUBRICATING OIL COMPOSITION CONTAINING SAME

(71) Applicants: ADEKA CORPORATION, Tokyo (JP); DIC CORPORATION, Tokyo (JP)

(72) Inventors: Shinji Iino, Tokyo (JP); Eiji Katsuno, Tokyo (JP); Taro Sumi, Tokyo (JP); Hironobu Matsueda, Ibaraki (JP); Hiroshi Sakata, Ibaraki (JP)

(73) Assignees: ADEKA CORPORATION, Tokyo (JP); DIC CORPORATION, Tokyo (JP)

( * ) Notice: Subject to any disclaimer, the term of this patent is extended or adjusted under 35 U.S.C. 154(b) by 69 days.

(21) Appl. No.: 17/629,997

(22) PCT Filed: Jul. 14, 2020

(86) PCT No.: PCT/JP2020/027352

§ 371 (c)(1),
(2) Date: Jan. 25, 2022

(87) PCT Pub. No.: WO2021/020107

PCT Pub. Date: Feb. 4, 2021

(65) Prior Publication Data

US 2022/0259515 A1 Aug. 18, 2022

(30) Foreign Application Priority Data

Jul. 26, 2019 (JP) ..... 2019-137391

(51) Int. Cl.
*C10M 135/36* (2006.01)
*C10M 135/18* (2006.01)
*C10M 169/04* (2006.01)

(52) U.S. Cl.
CPC ..... *C10M 135/36* (2013.01); *C10M 135/18* (2013.01); *C10M 169/04* (2013.01);
(Continued)

(58) Field of Classification Search
CPC ..... C10M 135/36; C10M 135/18; C10M 169/04; C10M 2203/003; C10M 2219/068;
(Continued)

(56) References Cited

U.S. PATENT DOCUMENTS 4,395,343 A * 7/1983 de Vries ..... C10M 135/04 508/438
5,858,931 A * 1/1999 Tanaka ..... C10M 129/16 508/378

FOREIGN PATENT DOCUMENTS

EP 699739 A2 * 3/1996 ..... C10M 135/02
EP 811674 A1 * 12/1997 ..... B05C 5/008
(Continued)

OTHER PUBLICATIONS

International Search Report issued Sep. 15, 2020 in corresponding International (PCT) Patent Application No. PCT/JP2020/027352.

*Primary Examiner* — Cephia D Toomer
(74) *Attorney, Agent, or Firm* — WENDEROTH, LIND & PONACK, L.L.P.

(57) ABSTRACT

The present invention provides a lubricating oil additive, including: a molybdenum compound (A) represented by the following general formula (1); and a sulfur-based composition (B) containing a sulfur-based compound (b-1) represented by the following general formula (2) and at least one kind of sulfur-based compound (b-2) represented by the following general formula (3) or (4), and a lubricating oil composition containing the additive. In the formula (1), $R^1$ to $R^4$ each represent alkyl groups having 6 to 18 carbon atoms, the groups being identical to or different from each other, and $X^1$ to $X^4$ each independently represent an oxygen atom or a sulfur atom. In the formula (2), $R^5$ and $R^6$ each represent alkyl groups having 3 to 24 carbon atoms, the groups being identical to or different from each other, and "a" and "b" each represent a number from 1 to 5. In the formulae (3) and (4), $R^7$ to $R^{10}$ each represent alkylene groups having 1 to 28 carbon atoms, the groups being identical to or different from each other, $R^{11}$ and $R^{12}$ each independently represent a hydrogen atom or an alkyl group having 1 to 3 carbon atoms, and "c" and "d" each independently represent a number from 1 to 8, provided that at least one of $R^{11}$ or $R^{12}$ represents an alkyl group having 1 to 3 carbon atoms.

(1)

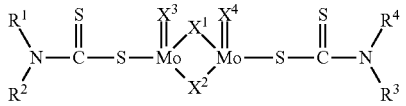

(2)

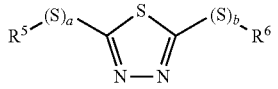

(3)

$$HOOC—R^7—(S)_c—R^8—COOH$$

(4)

$$R^{11}OOC—R^9—(S)_d—R^{10}—COOR^{12}$$

8 Claims, No Drawings

(52) U.S. Cl.
CPC . *C10M 2203/003* (2013.01); *C10M 2219/068* (2013.01); *C10M 2219/106* (2013.01)

(58) Field of Classification Search
CPC ..... C10M 2219/106; C10M 141/08; C10M 2219/085; C10M 2223/045; C10M 135/00; C10N 2030/06; C10N 2040/25
See application file for complete search history.

(56) References Cited

FOREIGN PATENT DOCUMENTS

| | | |
|---|---|---|
| JP | 51-80825 | 7/1976 |
| JP | 62-81396 | 4/1987 |
| JP | 4-182494 | 6/1992 |
| JP | 7-53983 | 2/1995 |
| JP | 2014-514407 | 6/2014 |
| JP | 2017-88550 | 5/2017 |

* cited by examiner

LUBRICATING OIL ADDITIVE AND LUBRICATING OIL COMPOSITION CONTAINING SAME

TECHNICAL FIELD

The present invention relates to a lubricating oil additive excellent in initial friction characteristic and long-term friction characteristic, and a lubricating oil composition.

BACKGROUND ART

From the viewpoints of the protection of earth resources and measures against environmental problems, an improvement in lubricity of a lubricating oil, such as a lubricating oil for an internal combustion engine or an industrial lubricating oil, through a reduction in frictional resistance thereof with an additive is effective, and hence various additives have been developed. Of such additives, molybdenum dithiocarbamates having various structures have been developed and utilized because the molybdenum dithiocarbamates have small corrosive properties on metals (see, for example, Patent Literatures 1 to 6).

However, it was found that a high friction-reducing effect at the initial stage of its use, which the molybdenum dithiocarbamate exhibits, is reduced in friction-reducing effect as the molybdenum dithiocarbamate is continuously used as, for example, an engine oil for a long time period for a travel distance of more than ten thousand kilometers. In view of the foregoing, the inventors of the present invention made an attempt to develop a lubricating oil additive capable of maintaining a high level of reducing effect on the frictional resistance of a lubricating oil for a longer time period.

CITATION LIST

Patent Literature

[PTL 1] JP 51-080825 A
[PTL 2] JP 62-081396 A
[PTL 3] JP 04-182494 A
[PTL 4] JP 07-053983 A
[PTL 5] JP 2014-514407 A
[PTL 6] JP 2017-088550 A

SUMMARY OF INVENTION

Technical Problem

Accordingly, an object of the present invention is to provide a lubricating oil additive excellent in initial friction characteristic and long-term friction characteristic, and a lubricating oil composition.

Solution to Problem

The inventors of the present invention made extensive investigations with a view to solving the problem, and as a result, have found that a lubricating oil additive comprising a specific molybdenum compound and a specific sulfur-based composition is excellent in initial friction characteristic and long-term friction characteristic. Thus, the inventors completed the present invention. That is, the present invention is directed to a lubricating oil additive, comprising: a molybdenum compound (A) represented by the following general formula (1); and a sulfur-based composition (B) containing a sulfur-based compound (b-1) represented by the following general formula (2) and at least one kind of sulfur-based compound (b-2) represented by the following general formula (3) or (4):

(1)

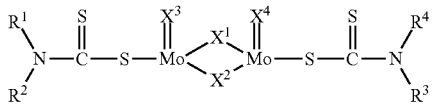

where $R^1$ to $R^4$ each represent alkyl groups having 6 to 18 carbon atoms, the groups being identical to or different from each other, and $X^1$ to $X^4$ each independently represent an oxygen atom or a sulfur atom;

(2)

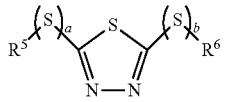

where $R^5$ and $R^6$ each represent alkyl groups having 3 to 24 carbon atoms, the groups being identical to or different from each other, and "a" and "b" each represent a number from 1 to 5;

(3)

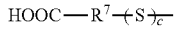

(4)

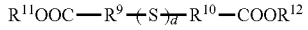

where $R^7$ to $R^{10}$ each represent alkylene groups having 1 to 28 carbon atoms, the groups being identical to or different from each other, $R^{11}$ and $R^{12}$ each independently represent a hydrogen atom or an alkyl group having 1 to 3 carbon atoms, and "c" and "d" each independently represent a number from 1 to 8, provided that at least one of $R^{11}$ or $R^{12}$ represents an alkyl group having 1 to 3 carbon atoms.

Advantageous Effects of Invention

The lubricating oil additive of the present invention can improve the initial friction characteristic and long-term friction characteristic of a lubricating oil.

DESCRIPTION OF EMBODIMENTS

A molybdenum compound (A) to be used in the present invention is a molybdenum compound represented by the following general formula (1).

(1)

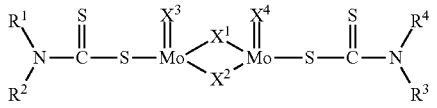

$R^1$ to $R^4$ in the general formula (1) each represent alkyl groups having 6 to 18 carbon atoms, the groups being identical to or different from each other. Examples of the alkyl group having 6 to 18 carbon atoms include: linear alkyl groups, such as a n-hexyl group, a n-heptyl group, a n-octyl group, a n-nonyl group, a n-decyl group, a n-undecyl group, a n-dodecyl group, a n-tridecyl group, and a n-tetradecyl group; and branched alkyl groups, such as a secondary hexyl group, a secondary heptyl group, a secondary octyl group, an isooctyl group, a secondary nonyl group, an isononyl group, a secondary decyl group, an isodecyl group, a secondary undecyl group, an isoundecyl group, a secondary dodecyl group, an isododecyl group, a secondary tridecyl group, an isotridecyl group, a secondary tetradecyl group, and an isotetradecyl group. From the viewpoints of the friction characteristics of the lubricating oil additive of the present invention, $R^1$ to $R^4$ each independently represent preferably a linear or branched alkyl group having 8 to 14 carbon atoms, particularly preferably a linear or branched alkyl group having 8 or 13 carbon atoms. For example, $R^1$ to $R^4$ each preferably represent an ethylhexyl group or an isotridecyl group. In addition, from the viewpoints of the friction characteristics of the lubricating oil additive of the present invention, it is preferred that $R^1$ and $R^2$ represent the same alkyl group, and $R^3$ and $R^4$ represent the same alkyl group.

$X^1$ to $X^4$ in the general formula (1) each independently represent an oxygen atom or a sulfur atom. From the viewpoints of the friction characteristics of the lubricating oil additive of the present invention, it is preferred that two or three of $X^1$ to $X^4$ each represent a sulfur atom and the others each represent an oxygen atom, it is more preferred that the number of sulfur atoms and the number of oxygen atoms be each 2, and it is most preferred that $X^1$ and $X^2$ each represent a sulfur atom, and $X^3$ and $X^4$ each represent an oxygen atom.

For example, the molybdenum compound (A) to be used in the present invention is preferably such that $R^1$ and $R^2$ each represent an ethylhexyl group, $R^3$ and $R^4$ each represent an isotridecyl group, $X^1$ and $X^2$ each represent a sulfur atom, and $X^3$ and $X^4$ each represent an oxygen atom.

One kind of the molybdenum compounds each represented by the general formula (1) may be used as the molybdenum compound (A) to be used in the present invention, or two or more kinds thereof may be used. In addition, a commercial product may be used as the molybdenum compound (A) to be used in the present invention, or the compound may be produced by a known production method (e.g., a method described in JP 51-80825 A or JP 08-217782 A).

A sulfur-based compound (b-1) to be used in the present invention is a sulfur-based compound represented by the following general formula (2).

(2)

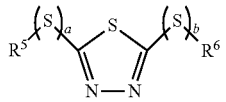

$R^5$ and $R^6$ in the general formula (2) each represent alkyl groups having 3 to 24 carbon atoms, the groups being identical to or different from each other. Examples of such alkyl group include a linear alkyl group having 3 to 24 carbon atoms and a branched alkyl group having 3 to 24 carbon atoms. From the viewpoints of the solubility of the lubricating oil additive of the present invention in a base oil and the friction characteristics thereof, $R^5$ and $R^6$ each represent preferably alkyl groups having 4 to 18 carbon atoms, more preferably alkyl groups having 5 to 14 carbon atoms, still more preferably alkyl groups having 6 to 12 carbon atoms, the groups being identical to or different from each other, out of those groups. In addition, the average of the number of carbon atoms of each of the alkyl groups represented by $R^5$ and $R^6$ is not particularly limited, but from the viewpoints of the friction characteristics of the lubricating oil additive of the present invention, for example, the average of the number of carbon atoms of each of the groups is preferably from 4 to 18, more preferably from 5 to 16, still more preferably from 6 to 14, still more preferably from 8 to 12. In the present invention, the average of the number of carbon atoms of each of the alkyl groups represented by $R^5$ and $R^6$ may be calculated by using a nuclear magnetic resonance spectrum and liquid chromatography.

"a" and "b" in the general formula (2) each represent a number from 1 to 5. From the viewpoints of the friction characteristics of the lubricating oil additive of the present invention, "a" and "b" each represent preferably from 1 to 4, more preferably from 1 to 3. In addition, the average of each of "a" and "b" is not limited, but from the viewpoints of the friction characteristics of the lubricating oil additive of the present invention, the average of each of "a" and "b" is preferably from 2.0 to 3.0, more preferably from 2.0 to 2.5. In the present invention, the average of each of "a" and "b" may be calculated by using a nuclear magnetic resonance spectrum and liquid chromatography.

One kind of the sulfur-based compounds each represented by the general formula (2) may be used as the sulfur-based compound (b-1) to be used in the present invention, or two or more kinds thereof may be used.

A sulfur-based compound (b-2) to be used in the present invention is a sulfur-based compound represented by the following general formula (3) or (4).

$$HOOC-R^7-(S)_c-R^8-COOH \quad (3)$$

$$R^{11}OOC-R^9-(S)_d-R^{10}-COOR^{12} \quad (4)$$

$R^7$ and $R^8$ in the general formula (3) each represent alkylene groups having 1 to 28 carbon atoms, the groups being identical to or different from each other. Examples of such group include a linear alkylene group having 1 to 28 carbon atoms and a branched alkylene group having 3 to 28 carbon atoms. From the viewpoints of the friction characteristics of the lubricating oil additive of the present invention, $R^7$ and $R^8$ each represent preferably alkylene groups having 4 to 26 carbon atoms, more preferably alkylene groups having 6 to 24 carbon atoms, still more preferably alkylene groups having 7 to 21 carbon atoms, the groups being identical to or different from each other, out of those groups.

In addition, the average of the number of carbon atoms of each of the alkylene groups represented by $R^7$ and $R^8$ is not particularly limited, but from the viewpoints of the friction characteristics of the lubricating oil additive of the present invention, the average of the number of carbon atoms of each of the groups is preferably from 4 to 26, more preferably from 6 to 24, still more preferably from 8 to 20, still more preferably from 10 to 18. In addition, from the viewpoints of the friction characteristics of the lubricating oil additive of the present invention, it is preferred that $R^7$ and $R^8$ represent alkylene groups having the same number of carbon atoms (when the alkylene groups represented by $R^7$ and $R^8$ each have a carbon number distribution in a specific range, the ranges and averages of the numbers of carbon atoms of the alkylene groups represented by $R^7$ and $R^8$ be identical to each other). In the present invention, the average of the number of carbon atoms of each of the alkylene groups represented by $R^7$ and $R^8$ may be calculated by using a nuclear magnetic resonance spectrum and liquid chromatography.

"c" in the general formula (3) represents a number from 1 to 8. From the viewpoints of the friction characteristics of the lubricating oil additive of the present invention, "c" represents preferably from 1 to 6, more preferably from 1 to 5. In addition, the average of "c" is not limited, but from the viewpoints of the friction characteristics of the lubricating oil additive of the present invention, the average of "c" is preferably from 2 to 5, more preferably from 2.5 to 3.5, still more preferably from 3.0 to 3.4. In the present invention, the average of "c" may be calculated by using a nuclear magnetic resonance spectrum and liquid chromatography.

$R^5$ and $R^{10}$ in the general formula (4) each represent alkylene groups having 1 to 28 carbon atoms, the groups being identical to or different from each other. Examples of such group include a linear alkylene group having 1 to 28 carbon atoms and a branched alkylene group having 3 to 28 carbon atoms. From the viewpoints of the friction characteristics of the lubricating oil additive of the present invention, $R^9$ and $R^{10}$ each represent preferably alkylene groups having 4 to 26 carbon atoms, more preferably alkylene groups having 6 to 24 carbon atoms, still more preferably alkylene groups having 7 to 21 carbon atoms, the groups being identical to or different from each other, out of those groups.

In addition, the average of the number of carbon atoms of each of the alkylene groups represented by $R^9$ and $R^{10}$ is not particularly limited, but from the viewpoints of the friction characteristics of the lubricating oil additive of the present invention, the average of the number of carbon atoms of each of the groups is preferably from 4 to 26, more preferably from 6 to 24, still more preferably from 8 to 20, still more preferably from 10 to 18. In addition, from the viewpoints of the friction characteristics of the lubricating oil additive of the present invention, it is preferred that $R^9$ and $R^{10}$ represent alkylene groups having the same number of carbon atoms (when the alkylene groups represented by $R^9$ and $R^{10}$ each have a carbon number distribution in a specific range, the ranges and averages of the numbers of carbon atoms of the alkylene groups represented by $R^9$ and $R^{10}$ be identical to each other). In the present invention, the average of the number of carbon atoms of each of the alkylene groups represented by $R^9$ and $R^{10}$ may be calculated by using a nuclear magnetic resonance spectrum and liquid chromatography.

$R^{11}$ and $R^{12}$ in the general formula (4) each represent a hydrogen atom or an alkyl group having 1 to 3 carbon atoms, provided that at least one of $R^{11}$ or $R^{12}$ represents an alkyl group having 1 to 3 carbon atoms. Examples of the alkyl group having 1 to 3 carbon atoms include a methyl group, an ethyl group, a propyl group, and an isopropyl group. From the viewpoints of the friction characteristics of the lubricating oil additive of the present invention, $R^{11}$ and $R^{12}$ each preferably represent an alkyl group having 1 to 3 carbon atoms out of those groups.

"d" in the general formula (4) represents a number from 1 to 8. From the viewpoints of the friction characteristics of the lubricating oil additive of the present invention, "d" represents preferably from 1 to 6, more preferably from 1 to 5. In addition, the average of "d" is not limited, but from the viewpoints of the friction characteristics of the lubricating oil additive of the present invention, the average of "d" is preferably from 2 to 5, more preferably from 2.5 to 3.5, still more preferably from 3.0 to 3.4. In the present invention, the average of "d" may be calculated by using a nuclear magnetic resonance spectrum and liquid chromatography.

Only one or more kinds of sulfur-based compounds each represented by the general formula (3) may be used as the sulfur-based compounds (b-2), only one or more kinds of sulfur-based compounds each represented by the general formula (4) may be used, or one or more kinds of the sulfur-based compounds each represented by the general formula (3) and one or more kinds of the sulfur-based compounds each represented by the general formula (4) may be used.

A sulfur-based composition (B) of the present invention is a sulfur-based composition containing the sulfur-based compound (b-1) and the sulfur-based compound (b-2) described above. A content ratio between the sulfur-based compound (b-1) and the sulfur-based compound (b-2) in the sulfur-based composition (B) of the present invention is not particularly limited, but from the viewpoints of the friction characteristics of the lubricating oil additive of the present invention, a mass ratio "b-1:b-2" between the contents of the sulfur-based compound (b-1) and the sulfur-based compound (b-2) in the sulfur-based composition (B) is preferably from 0.5:99.5 to 95:5, more preferably from 10:90 to 80:20, still more preferably from 20:80 to 60:40.

The sulfur-based composition (B) to be used in the present invention may consist of one or more kinds of the sulfur-based compounds (b-1) and one or more kinds of the sulfur-based compounds (b-2), or may further contain, as any other sulfur-based compound, one or more kinds of sulfur-based compounds selected from the group consisting of a thioether-based compound (sulfide-based compound), a disulfide-based compound, a polysulfide-based compound, and a thioester-based compound except the sulfur-based compound (b-1) and the sulfur-based compound (b-2). When the sulfur-based composition (B) contains the other sulfur-based compound except the sulfur-based compound (b-1) and the sulfur-based compound (b-2), from the viewpoints of the friction characteristics of the lubricating oil additive of the present invention, the total amount of the sulfur-based compound (b-1) and the sulfur-based compound (b-2) in the sulfur-based composition (B) is preferably from 30 mass % to 99.9 mass %, more preferably from 50 mass % to 99 mass % with respect to the entire amount of the sulfur-based composition (B).

An example of the other sulfur-based compound that may be incorporated into the sulfur-based composition (B) to be used in the present invention is a sulfur-based compound (b-3) represented by the following general formula (5).

(5)

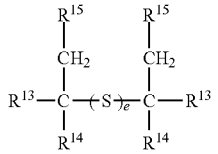

$R^{13}$ in the general formula (5) represents an alkyl group having 1 to 22 carbon atoms. Examples of such alkyl group include a linear alkyl group having 1 to 22 carbon atoms and a branched alkyl group having 3 to 22 carbon atoms. From the viewpoints of the friction characteristics of the lubricating oil additive of the present invention, $R^{13}$ represents preferably an alkyl group having 1 to 14 carbon atoms, more preferably an alkyl group having 1 to 12 carbon atoms, still more preferably an alkyl group having 1 to 8 carbon atoms out of those groups.

$R^{14}$ in the general formula (5) represents a hydrogen atom or an alkyl group having 1 to 20 carbon atoms. Examples of the alkyl group having 1 to 20 carbon atoms include a linear alkyl group having 1 to 20 carbon atoms and a branched alkyl group having 3 to 20 carbon atoms. From the viewpoints of the friction characteristics of the lubricating oil additive of the present invention, $R^{14}$ represents preferably a hydrogen atom or an alkyl group having 1 to 12 carbon atoms, more preferably a hydrogen atom or an alkyl group having 1 to 8 carbon atoms, still more preferably a hydrogen atom or an alkyl group having 1 to 4 carbon atoms out of those groups.

$R^{15}$ in the general formula (5) represents a hydrogen atom or an alkyl group having 1 to 20 carbon atoms. Examples of the alkyl group having 1 to 20 carbon atoms include a linear alkyl group having 1 to 20 carbon atoms and a branched alkyl group having 3 to 20 carbon atoms. From the viewpoints of the friction characteristics of the lubricating oil additive of the present invention, $R^{15}$ represents preferably a hydrogen atom or an alkyl group having 1 to 12 carbon atoms, more preferably a hydrogen atom or an alkyl group having 1 to 8 carbon atoms, still more preferably a hydrogen atom or an alkyl group having 1 to 4 carbon atoms, particularly preferably a hydrogen atom out of those groups.

"e" in the general formula (5) represents a number from 1 to 10. From the viewpoints of the friction characteristics of the lubricating oil additive of the present invention, "e" preferably represents from 1 to 8. In addition, the average of "e" is not limited, but from the viewpoints of the friction characteristics of the lubricating oil additive of the present invention, the average of "e" is preferably from 2 to 6, more preferably from 2.5 to 4.5. In the present invention, the average of "e" may be calculated by using a nuclear magnetic resonance spectrum and liquid chromatography.

From the viewpoints of the friction characteristics of the lubricating oil additive of the present invention, the sulfur-based compound (b-3) is such that in the general formula (5), the total of the number of carbon atoms of one $R^{13}$ and the number of carbon atoms of one $R^{14}$ is preferably from 1 to 20, more preferably from 2 to 14, still more preferably from 4 to 10.

From the viewpoints of the friction characteristics of the lubricating oil additive of the present invention, the sulfur-based compound (b-3) is such that in the general formula (5), the total of the number of carbon atoms of one $R^{13}$, the number of carbon atoms of one $R^{14}$, and the number of carbon atoms of one $R^{15}$ is preferably from 1 to 22, more preferably from 2 to 16, still more preferably from 4 to 12.

When the sulfur-based composition (B) of the present invention contains the sulfur-based compound (b-1), the sulfur-based compound (b-2), and the sulfur-based compound (b-3) described above, a content ratio among the sulfur-based compound (b-1), the sulfur-based compound (b-2), and the sulfur-based compound (b-3) in the sulfur-based composition (B) is not particularly limited, but from the viewpoints of the friction characteristics of the lubricating oil additive of the present invention, a mass ratio "b-1:b-2:b-3" among the contents of the sulfur-based compound (b-1), the sulfur-based compound (b-2), and the sulfur-based compound (b-3) in the sulfur-based composition (B) is preferably 5 to 90:5 to 90:0.1 to 70 (the total of the mass ratios of the compounds (b-1), (b-2), and (b-3) is 100), more preferably 20 to 60:10 to 50:1 to 50 (the total of the mass ratios of the compounds (b-1), (b-2), and (b-3) is 100).

The sulfur element ratio of the sulfur-based composition (B) of the present invention (mass ratio of a sulfur element in the total mass of the sulfur-based composition (B)) is not particularly limited, but from the viewpoints of the friction characteristics of the lubricating oil additive of the present invention, the sulfur element ratio of the sulfur-based composition (B) is preferably from 5 mass % to 50 mass %, more preferably from 10 mass % to 40 mass %. In the present invention, the use of a sulfur-based composition having a specific chemical structure and having a sulfur element ratio in such range can provide a lubricating oil additive showing an excellent initial friction characteristic and an excellent long-term friction characteristic through a synergistic effect with the molybdenum compound (A). In the present invention, the sulfur element ratio may be calculated by using fluorescent X-ray analysis.

A commercial product may be used as each of the sulfur-based compound (b-1), the sulfur-based compound (b-2), and the sulfur-based compound (b-3) to be used in the present invention, or each of the compounds may be produced by a known production method. Examples of a method of producing the sulfur-based compound (b-1) include: a method described in J. Chem. Soc. 123, 964 (1923) including using sulfur monochloride; a method described in Sci. Papers Inst. Phys. Chem. Res. (Tokyo) 7, 237 (1928) including using thionyl chloride; a method described in Zh. Obshch. Khim. 30, 3031 (1960) including using a halogenating agent, such as phosphorus pentachloride; a method described in J. Prakt. Chem. 69, 44 (1904) including using ammonium persulfate; a method described in Yakugaku Zasshi, 58, 809 (1938) including using a hydrogen peroxide solution; a method described in Izv. Akad. NaukSSSR, Ser. Khim., (5) 1143 (1986) including using a peroxide, such as sodium persulfate-cupric chloride; a method described in Bull. Soc. Chem. France D 272 (1949) including using ozone; and a method described in Bull. Chem. Soc. Jpn., 55, 641 (1982) including using bis(p-methoxyphenyl)selenium oxide, an example of a method of producing the sulfur-based compound (b-2) is a method described in JP 61-183392 A, and an example of a method of producing the sulfur-based compound (b-3) is a method described in JP 5835530 B2.

A content ratio between the molybdenum compound (A) and the sulfur-based composition (B) in the lubricating oil additive of the present invention is not particularly limited, but from the viewpoints of the friction characteristics of the lubricating oil additive of the present invention, a mass ratio "A:B" between the contents of the molybdenum compound (A) and the sulfur-based composition (B) in the lubricating oil additive is preferably from 30:70 to 90:10, more preferably from 40:60 to 80:20, still more preferably from 50:50 to 70:30.

A mass ratio between the content of a molybdenum element derived from the molybdenum compound (A) and the content of a sulfur element derived from the sulfur-based composition (B) in the lubricating oil additive of the present invention is not particularly limited, but from the viewpoints of the friction characteristics of the lubricating oil additive of the present invention, the mass ratio "Mo:S" between the content of the molybdenum element derived from the molybdenum compound (A) and the content of the sulfur element derived from the sulfur-based composition (B) in the lubricating oil additive is preferably from 20:80 to 80:20, more preferably from 30:70 to 70:30.

The kind of a lubricating oil in which the lubricating oil additive of the present invention is used is not particularly limited, and the additive may be used in, for example, a lubricating oil for an internal combustion engine (e.g., a gasoline engine oil or a diesel engine oil for an automobile, a motorcycle, or the like) or an industrial lubricating oil (e.g., a gear oil, a turbine oil, an oil film bearing oil, a lubricating oil for a refrigerator, a vacuum pump oil, a lubricating oil for compression, or a multipurpose lubricating oil). The additive is preferably used as an additive for a lubricating oil for an internal combustion engine, such as a gasoline engine or a diesel engine, out of those lubricating oils because the effect of the present invention is easily obtained.

A lubricating oil composition of the present invention is a lubricating oil composition comprising: a base oil; a molybdenum compound (A) represented by the following general formula (1); and a sulfur-based composition (B) containing a sulfur-based compound (b-1) represented by the following general formula (2) and at least one kind of sulfur-based compound (b-2) represented by the following general formula (3) or (4).

(1)

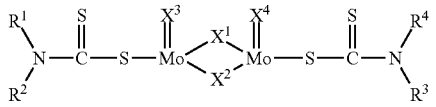

In the formula, $R^1$ to $R^4$ each represent alkyl groups having 6 to 18 carbon atoms, the groups being identical to or different from each other, and $X^1$ to $X^4$ each independently represent an oxygen atom or a sulfur atom.

(2)

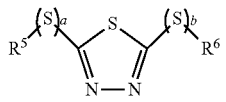

In the formula, $R^5$ and $R^6$ each represent alkyl groups having 3 to 24 carbon atoms, the groups being identical to or different from each other, and "a" and "b" each represent a number from 1 to 5.

(3)

$$HOOC-R^7-(S)_c-R^8-COOH$$

(4)

$$R^{11}OOC-R^9-(S)_d-R^{10}-COOR^{12}$$

In the formulae, $R^7$ to $R^{10}$ each represent alkylene groups having 1 to 28 carbon atoms, the groups being identical to or different from each other, $R^{11}$ and $R^{12}$ each independently represent a hydrogen atom or an alkyl group having 1 to 3 carbon atoms, and "c" and "d" each independently represent a number from 1 to 8, provided that at least one of $R^{11}$ or $R^{12}$ represents an alkyl group having 1 to 3 carbon atoms.

The base oil to be used in the present invention is not particularly limited, and may be appropriately selected from, for example, a mineral base oil, a chemically synthesized base oil, animal and vegetable base oils, and a mixed base oil thereof depending on its intended use and use conditions. Herein, examples of the mineral base oil include a paraffin base crude oil, a naphthene base crude oil, an intermediate base crude oil, and an aromatic base crude oil, distillates obtained by distilling those oils under normal pressure, distillates obtained by distilling, under reduced pressure, the residual oils of the distillation under normal pressure, and refined oils obtained by refining those distillates in accordance with an ordinary method, specifically a solvent-refined oil, a hydrogenated refined oil, a dewaxed oil, and a clay-treated oil.

Examples of the chemically synthesized base oil include a poly-α-olefin, polyisobutylene (polybutene), a monoester, a diester, a polyol ester, a silicic acid ester, a polyalkylene glycol, polyphenyl ether, a silicone, a fluorinated compound, an alkylbenzene, and a GTL base oil. Of those, a poly-α-olefin, polyisobutylene (polybutene), a diester, a polyol ester, and the like may be universally used. Examples of the poly-α-olefin include polymerized forms or oligomerized forms of 1-hexene, 1-octene, 1-nonene, 1-decene, 1-dodecene, and 1-tetradecene, or hydrogenated forms thereof. Examples of the diester include diesters of dibasic acids, such as glutaric acid, adipic acid, azelaic acid, sebacic acid, and dodecanedioic acid, and alcohols, such as 2-ethylhexanol, octanol, decanol, dodecanol, and tridecanol. Examples of the polyol ester include esters of polyols, such as neopentyl glycol, trimethylolethane, trimethylolpropane, pentaerythritol, dipentaerythritol, and tripentaerythritol, and fatty acids, such as caproic acid, caprylic acid, lauric acid, capric acid, myristic acid, palmitic acid, stearic acid, and oleic acid.

Examples of the animal and vegetable base oils include: vegetable oils and fats, such as castor oil, olive oil, cacao butter, sesame oil, rice bran oil, safflower oil, soybean oil, camellia oil, corn oil, rapeseed oil, palm oil, palm kernel oil, sunflower oil, cotton seed oil, and coconut oil; and animal oils and fats, such as beef tallow, lard, milk fat, fish oil, and whale oil. Those various base oils described above may be used alone or in appropriate combination thereof.

The content of the base oil in the lubricating oil composition of the present invention is not particularly limited, but from the viewpoints of the friction characteristics of the lubricating oil composition, the content of the base oil is preferably from 50 mass % to 99.9 mass %, more preferably from 60 mass % to 99 mass % with respect to the entire amount of the lubricating oil composition.

Specifically, a compound having the above-mentioned structure may be used as each of the molybdenum compound (A) represented by the general formula (1), the sulfur-based compound (b-1), and the sulfur-based compound (b-2) to be used in the lubricating oil composition of the present invention.

In addition, the lubricating oil composition of the present invention may comprise, as a component of the sulfur-based composition (B), a sulfur-based compound (b-3) represented by the following general formula (5).

(5)

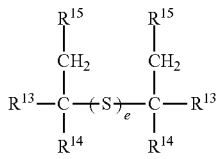

In the formula, $R^{13}$ represents an alkyl group having 1 to 22 carbon atoms, $R^{14}$ represents a hydrogen atom or an alkyl group having 1 to 20 carbon atoms, $R^{15}$ represents a hydrogen atom or an alkyl group having 1 to 20 carbon atoms, and "e" represents a number from 1 to 10.

Specifically, a compound having the above-mentioned structure may be used as the sulfur-based compound (b-3).

The content of the molybdenum compound (A) in the lubricating oil composition of the present invention is not particularly limited, but from the viewpoints of the friction characteristics of the lubricating oil composition, the content is such an amount that the content of a molybdenum element derived from the molybdenum compound (A) in the lubricating oil composition is preferably from 200 ppm by mass to 2,000 ppm by mass, more preferably from 400 ppm by mass to 1,800 ppm by mass, still more preferably from 600 ppm by mass to 1,600 ppm by mass.

The content of the sulfur-based composition (B) in the lubricating oil composition of the present invention is not particularly limited, but from the viewpoints of the friction characteristics of the lubricating oil composition, the content is such an amount that the content of a sulfur element derived from the sulfur-based composition (B) in the lubricating oil composition is preferably from 200 ppm by mass to 2,000 ppm by mass, more preferably from 400 ppm by mass to 1,600 ppm by mass, still more preferably from 500 ppm by mass to 1,400 ppm by mass.

A content ratio between the molybdenum compound (A) and the sulfur-based composition (B) in the lubricating oil composition of the present invention is not particularly limited, but from the viewpoints of the friction characteristics of the lubricating oil composition, the ratio is such a ratio that a ratio between the content of the molybdenum element derived from the molybdenum compound (A) and the content of the sulfur element derived from the sulfur-based composition (B) is preferably from 20:80 to 80:20, more preferably from 30:70 to 70:30. In the present invention, the incorporation of the specific molybdenum compound (A) and the specific sulfur-based composition at such mass ratio can provide a lubricating oil composition showing an excellent initial friction characteristic and an excellent long-term friction characteristic.

The content of the sulfur element in the lubricating oil composition of the present invention is not particularly limited, and only needs to be adjusted in accordance with purposes. However, from the viewpoints of the various characteristics of the lubricating oil composition, for example, the content of the sulfur element in the lubricating oil composition is preferably from 500 ppm by mass to 8,000 ppm by mass, more preferably from 2,000 ppm by mass to 7,000 ppm by mass, still more preferably from 3,000 ppm by mass to 6,000 ppm by mass.

A known lubricating oil additive may be further appropriately used in the lubricating oil composition of the present invention in accordance with use purposes, and examples thereof include: a metal-based detergent; an ashless dispersant; an antioxidant; a phosphorus-based antiwear additive or a phosphorus-based antioxidant; a thiophosphoric acid-based extreme-pressure agent; an oiliness improver; a rust inhibitor; a viscosity index improver; a defoaming agent; and a solid lubricant. One or more kinds of compounds may be used as each of those additives.

[Metal-Based Detergent]

Examples of the metal-based detergent include an alkaline earth metal sulfonate, an alkaline earth metal phenate, an alkaline earth metal salicylate, and an alkaline earth metal phosphonate, and examples of the alkaline earth metal in such detergent include magnesium, calcium, and barium. Of those, at least one metal-based detergent selected from the group consisting of a calcium-based detergent and a magnesium-based detergent is preferably incorporated at a content of from 0.05 mass % to 0.4 mass % in terms of the total of a calcium element and a magnesium element with respect to the entire amount of the lubricating oil composition.

[Ashless Dispersant]

Examples of the ashless dispersant include: a succinimide-type dispersant obtained by a condensation reaction between an alkenyl succinic anhydride and a polyamine compound; a succinic acid ester-type dispersant obtained by a condensation reaction between an alkenyl succinic anhydride and a polyol compound; a succinic acid ester amide-type dispersant obtained by a condensation reaction between an alkenyl succinic anhydride and an alkanolamine; a Mannich base-based dispersant obtained by condensing an alkylphenol and polyamine with formaldehyde; and boric acid-modified products thereof. The lubricating oil composition preferably includes 0.5 mass % to 10 mass % of the ashless dispersant with respect to the entire amount of the lubricating oil composition.

[Antioxidant]

Examples of the antioxidant include an amine-based antioxidant, a phenol-based antioxidant, a phenothiazine-based antioxidant, and a phosphorous acid ester-based antioxidant. A preferred blending amount of the antioxidant is from about 0.1 mass % to about 10 mass % with respect to the entire amount of the lubricating oil composition.

[Phosphorus-Based Antiwear Additive or Phosphorus-Based Antioxidant]

Examples of the phosphorus-based antiwear additive or the phosphorus-based antioxidant include an organic phosphine, an organic phosphine oxide, an organic phosphinite, an organic phosphonite, an organic phosphinate, an organic phosphite, an organic phosphonate, an organic phosphate, and an organic phosphoramidate. A preferred blending amount of the phosphorus-based antiwear additive or the phosphorus-based antioxidant is, as a total amount thereof, from about 0.1 mass % to about 20 mass % with respect to the entire amount of the lubricating oil composition.

[Thiophosphoric Acid-Based Extreme-Pressure Agent]

Examples of the thiophosphoric acid-based extreme-pressure agent include an organic trithiophosphite and an organic thiophosphate. A preferred blending amount of the thiophosphoric acid-based extreme-pressure agent is from about 0.1 mass % to about 20 mass % with respect to the entire amount of the lubricating oil composition.

[Oiliness Improver]

Examples of the oiliness improver include a fatty acid, an oil and fat, and a hydrogenated product or partially saponified product thereof, an epoxidized ester, a polycondensate of hydroxystearic acid or an ester of the polycondensate and a fatty acid, a higher alcohol, a higher amide, a glyceride, a polyglycerin ester, a polyglycerin ether, and a product obtained by adding an α-olefin oxide to each of the above-mentioned compounds. A preferred blending amount of the oiliness improver is from about 0.05 mass % to about 15 mass % with respect to the entire amount of the lubricating oil composition.

[Rust Inhibitor]

Examples of the rust inhibitor include an oxidized paraffin wax calcium salt, an oxidized paraffin wax magnesium salt, a tallow fatty acid alkali metal salt, alkaline earth metal salt, or amine salt, an alkenylsuccinic acid or an alkenylsuccinic acid half ester (the molecular weight of an alkenyl group is from about 100 to about 300), a sorbitan monoester, a pentaerythritol monoester, a glycerin monoester, nonylphenol ethoxylate, a lanolin fatty acid ester, and a lanolin fatty acid calcium salt. A preferred blending amount of the rust inhibitor is from about 0.1 mass % to about 15 mass % with respect to the entire amount of the lubricating oil composition.

[Viscosity Index Improver]

Examples of the viscosity index improver include a poly (C1 to 18) alkyl methacrylate, a (C1 to 18) alkyl acrylate/(C1 to 18) alkyl methacrylate copolymer, a diethylaminoethyl methacrylate/(C1 to 18) alkyl methacrylate copolymer, an ethylene/(C1 to 18) alkyl methacrylate copolymer, polyisobutylene, a polyalkylstyrene, an ethylene/propylene copolymer, a styrene/maleic acid ester copolymer, a styrene/maleamide copolymer, a styrene/butadiene hydrogenated copolymer, and a styrene/isoprene hydrogenated copolymer. The average molecular weight of the viscosity index improver is from about 10,000 to about 1,500,000. A preferred blending amount of the viscosity index improver is from about 0.1 mass % to about 20 mass % with respect to the entire amount of the lubricating oil composition.

[Defoaming Agent]

Examples of the defoaming agent include polydimethylsilicone, trifluoropropylmethylsilicone, colloidal silica, a polyalkyl acrylate, a polyalkyl methacrylate, an alcohol ethoxy/propoxylate, a fatty acid ethoxy/propoxylate, and a sorbitan partial fatty acid ester. A preferred blending amount of the defoaming agent is from about 1 ppm by mass to about 1,000 ppm by mass with respect to the entire amount of the lubricating oil composition.

[Solid Lubricant]

Examples of the solid lubricant include graphite, molybdenum disulfide, polytetrafluoroethylene, a fatty acid alkaline earth metal salt, mica, cadmium dichloride, cadmium diiodide, calcium fluoride, lead iodide, lead oxide, titanium carbide, titanium nitride, aluminum silicate, antimony oxide, cerium fluoride, polyethylene, diamond powder, silicon nitride, boron nitride, carbon fluoride, and melamine isocyanurate. A preferred blending amount of the solid lubricant is from about 0.005 mass % to about 2 mass % with respect to the entire amount of the lubricating oil composition.

The usage mode of the lubricating oil composition of the present invention is not particularly limited, and the composition may be used as, for example, a lubricating oil for an internal combustion engine (e.g., a gasoline engine oil or a diesel engine oil for an automobile, a motorcycle, or the like) or an industrial lubricating oil (e.g., a gear oil, a turbine oil, an oil film bearing oil, a lubricating oil for a refrigerator, a vacuum pump oil, a lubricating oil for compression, or a multipurpose lubricating oil). The composition is preferably used as a composition for a lubricating oil for an internal combustion engine, such as a gasoline engine or a diesel engine, out of those lubricating oils because the effect of the present invention is easily obtained.

EXAMPLES

Now, the present invention is more specifically described by way of Examples. In the following Examples, "%" is by mass unless otherwise stated.

<Used Materials>

[Molybdenum Compound]

Molybdenum compound 1: A compound represented by the general formula (1) in which $R^1$ and $R^2$ each represent an ethylhexyl group, and $R^3$ and $R^4$ each represent an isotridecyl group (molybdenum element ratio: 10 mass %, sulfur element ratio: 11 mass %)

[Sulfur-Based Compound (b-1)]

b-1-1: A compound represented by the general formula (2) in which $R^5$ and $R^6$ each represent an alkyl group having 7 to 11 carbon atoms (the average number of carbon atoms of each of the alkyl groups is 9), and "a" and "b" each represent from 1 to 3 (the average of each of "a" and "b" is 2.1)

b-1-2: A compound represented by the general formula (2) in which $R^5$ and $R^6$ each represent an alkyl group having 6 to 10 carbon atoms (the average number of carbon atoms of each of the alkyl groups is 8), and "a" and "b" each represent from 1 to 3 (the average of each of "a" and "b" is 2.1)

b-1-3: A compound represented by the general formula (2) in which $R^5$ and $R^6$ each represent a linear alkyl group having 12 carbon atoms, and "a" and "b" each represent from 1 to 3 (the average of each of "a" and "b" is 2.1)

b-1-4: A compound represented by the general formula (2) in which $R^5$ and $R^6$ each represent a branched alkyl group having 12 carbon atoms, and "a" and "b" each represent from 1 to 3 (the average of each of "a" and "b" is 2.1)

[Sulfur-Based Compound (b-2)]

b-2-1: A compound represented by the general formula (3) in which $R^7$ and $R^8$ each represent an alkylene group having 14 to 22 carbon atoms (the average number of carbon atoms of each of the alkylene groups is 18), and "c" represents from 1 to 5 (the average of "c" is 3.2)

b-2-2: A compound represented by the general formula (3) in which $R^7$ and $R^8$ each represent an alkylene group having 8 to 14 carbon atoms (the average number of carbon atoms of each of the alkylene groups is 11), and "c" represents from 1 to 5 (the average of "c" is 3.2)

b-2-3: A compound represented by the general formula (4) in which $R^3$ and $R^{10}$ each represent an alkylene group having 14 to 22 carbon atoms (the average number of carbon atoms of each of the alkylene groups is 18), one of $R^{11}$ and $R^{12}$ represents an alkyl group having 1 to 3 carbon atoms, and the other thereof represents a hydrogen atom or an alkyl group having 1 to 3 carbon atoms, and "d" represents from 1 to 5 (the average of "d" is 3.2)

[Sulfur-Based Compound (b-3)]

b-3-1: A compound represented by the general formula (5) in which $R^{13}$ represents an alkyl group having 8 carbon atoms, $R^{14}$ and $R^{15}$ each represent a hydrogen atom, and "e" represents from 1 to 8 (the average of "e" is 4)

b-3-2: A compound represented by the general formula (5) in which $R^{13}$ and $R^{14}$ each represent an alkyl group having 1 to 5 carbon atoms (the total of the number of carbon atoms of one $R^{13}$ and the number of carbon atoms of one $R^{14}$ is 6), $R^{15}$ represents a hydrogen atom, and "e" represents from 1 to 8 (the average of "e" is 3)

[Base Oil]

Base Oil 1: A Chemically Synthesized Base Oil-Based Engine Oil (GF 5 Specification OW-20)

S element content: 2,500 ppm: metal detergent, derived from ZnDTP

<Preparation of Sulfur-Based Composition>

The respective sulfur-based compounds were mixed at mass ratios shown in Table 1 to prepare sulfur-based compositions 1 to 13. The sulfur-based compositions 1 to 10 each correspond to the sulfur-based composition (B) of the present invention, and the sulfur-based compositions 11 to 13 correspond to sulfur-based compositions serving as comparative components. In addition, the sulfur element ratios of the respective sulfur-based compositions are also shown in Table 1. The sulfur element ratios were measured in conformity with JIS K 2541-6:2013 with a fluorescent X-ray apparatus.

TABLE 1

| | | | Sulfur-based composition 1 | Sulfur-based composition 2 | Sulfur-based composition 3 | Sulfur-based composition 4 | Sulfur-based composition 5 | Sulfur-based composition 6 | Sulfur-based composition 7 |
|---|---|---|---|---|---|---|---|---|---|
| Sulfur-based compound | b-1 | b-1-1 | 41.6% | 41.7% | 41.7% | 41.7% | 90.0% | | |
| | | b-1-2 | 0.2% | 0.2% | | | | | |
| | | b-1-3 | | | | | | 41.7% | |
| | | b-1-4 | | | | | | | 41.7% |
| | b-2 | b-2-1 | 58.2% | 28.3% | | | 10.0% | 58.3% | 58.3% |
| | | b-2-2 | | | 58.3% | 28.4% | | | |
| | | b-2-3 | | 29.8% | | 29.9% | | | |
| | b-3 | b-3-1 | | | | | | | |
| | | b-3-2 | | | | | | | |
| Sulfur-based composition | | Sulfur element content ratio | 24.6% | 24.3% | 22.9% | 24.1% | 35.0% | 21.3% | 22.2% |

| | | | Sulfur-based composition 8 | Sulfur-based composition 9 | Sulfur-based composition 10 | Sulfur-based composition 11 | Sulfur-based composition 12 | Sulfur-based composition 13 |
|---|---|---|---|---|---|---|---|---|
| Sulfur-based compound | b-1 | b-1-1 | | | 20.7% | 100% | | 0.1% |
| | | b-1-2 | 0.2% | 0.5% | 0.1% | | 100% | |
| | | b-1-3 | | | | | | |
| | | b-1-4 | 41.7% | | | | | |
| | b-2 | b-2-1 | 28.3% | 48.4% | 14.2% | | | |
| | | b-2-2 | | | | | | |
| | | b-2-3 | 29.8% | 51.1% | 15.0% | | | |
| | b-3 | b-3-1 | | | 50.0% | | | 89.6% |
| | | b-3-2 | | | | | | 10.3% |
| Sulfur-based composition | | Sulfur element content ratio | 21.9% | 11.6% | 27.2% | 34.8% | 35.3% | 31.2% |

<Preparation of Lubricating Oil Additive and Lubricating Oil Composition (1)>

Lubricating oil compositions (Examples 1 to 12 and Comparative Examples 1 to 5) each comprising a lubricating oil additive consisting of the molybdenum compound and any one of the prepared sulfur-based compositions, and the base oil in blending amounts shown in Tables 2 to 6 were produced. The blending amounts of the molybdenum compound in the respective lubricating oil compositions are each represented by a molybdenum element content (ppm by mass) (Mo content (ppm)), and the blending amounts of the sulfur-based compositions therein are each represented by a sulfur element content (ppm by mass) (S content (ppm)). Comparative Examples 1 to 3 each represent an example in which a sulfur-based composition except the sulfur-based composition of the present invention is used, and Comparative Examples 4 and 5 each represent an example in which a lubricating oil additive free of any sulfur-based composition is used.

TABLE 2

| | | | Example 1 | | | Example 2 | | |
|---|---|---|---|---|---|---|---|---|
| | | | Mo content (ppm) Derived from (A) | S content (ppm) Derived from (B) | S content (ppm) (Derived from component except (B) | Mo content (ppm) Derived from (A) | S content (ppm) Derived from (B) | S content (ppm) Derived from component except (B) |
| Lubricating oil additive | Molybdenum compound | Molybdenum compound 1 | 1,400 | | 1,540 | 1,400 | | 1,540 |
| | Sulfur-based composition | Sulfur-based composition 1 | | 1,100 | | | | |
| | | Sulfur-based composition 2 | | | | | 1,100 | |
| | | Sulfur-based composition 3 | | | | | | |
| | | Sulfur-based composition 4 | | | | | | |
| | | Sulfur-based composition 5 | | | | | | |
| | | Sulfur-based composition 6 | | | | | | |

TABLE 2-continued

| | | | | | | | | |
|---|---|---|---|---|---|---|---|---|
| | | Sulfur-based composition 7 | | | | | | |
| | | Sulfur-based composition 8 | | | | | | |
| | | Sulfur-based composition 9 | | | | | | |
| | | Sulfur-based composition 10 | | | | | | |
| | | Sulfur-based composition 11 | | | | | | |
| | | Sulfur-based composition 12 | | | | | | |
| | | Sulfur-based composition 13 | | | | | | |
| Base oil | | Base oil 1 | | Balance | | | Balance | |
| Lubricating oil composition | | | 1,400 | 1,100 | 3,990 | 1,400 | 1,100 | 3,990 |
| Initial friction characteristic | | | | ○○ | | | ○○ | |
| Post-deterioration friction coefficient $\mu_1$ | | | | 0.065 | | | 0.088 | |
| Long-term friction characteristic | | | | ○○ | | | ○ | |

| | | | Example 3 | | | Example 4 | | |
|---|---|---|---|---|---|---|---|---|
| | | | Mo content (ppm) Derived from (A) | S content (ppm) Derived from (B) | S content (ppm) Derived from component except (B) | Mo content (ppm) Derived from (A) | S content (ppm) Derived from (B) | S content (ppm) Derived from component except (B) |
| Lubricating oil additive | Molybdenum compound | Molybdenum compound 1 | 1,400 | | 1,540 | 1,400 | | 1,540 |
| | Sulfur-based composition | Sulfur-based composition 1 | | | | | | |
| | | Sulfur-based composition 2 | | 1,100 | | | | |
| | | Sulfur-based composition 3 | | | | | | |
| | | Sulfur-based composition 4 | | | | | 1,100 | |
| | | Sulfur-based composition 5 | | | | | | |
| | | Sulfur-based composition 6 | | | | | | |
| | | Sulfur-based composition 7 | | | | | | |
| | | Sulfur-based composition 8 | | | | | | |
| | | Sulfur-based composition 9 | | | | | | |
| | | Sulfur-based composition 10 | | | | | | |
| | | Sulfur-based composition 11 | | | | | | |
| | | Sulfur-based composition 12 | | | | | | |
| | | Sulfur-based composition 13 | | | | | | |
| Base oil | | Base oil 1 | | Balance | | | Balance | |
| Lubricating oil composition | | | 1,400 | 1,100 | 3,990 | 1,400 | 1,100 | 3,990 |
| Initial friction characteristic | | | | ○○ | | | ○○ | |
| Post-deterioration friction coefficient $\mu_1$ | | | | 0.090 | | | 0.089 | |
| Long-term friction characteristic | | | | ○ | | | ○ | |

TABLE 3

| | | | Example 5 | | | Example 6 | | |
|---|---|---|---|---|---|---|---|---|
| | | | Mo content (ppm) Derived from (A) | S content (ppm) Derived from (B) | S content (ppm) Derived from component except (B) | Mo content (ppm) Derived from (A) | S content (ppm) Derived from (B) | S content (ppm) Derived from component except (B) |
| Lubricating oil additive | Molybdenum compound | Molybdenum compound 1 | 1,400 | | 1,540 | 1,400 | | 1,540 |
| | Sulfur-based composition | Sulfur-based composition 1 | | | | | | |
| | | Sulfur-based composition 2 | | | | | | |
| | | Sulfur-based composition 3 | | | | | | |
| | | Sulfur-based composition 4 | | | | | | |
| | | Sulfur-based composition 5 | | 1,100 | | | | |
| | | Sulfur-based composition 6 | | | | | 1,100 | |
| | | Sulfur-based composition 7 | | | | | | |
| | | Sulfur-based composition 8 | | | | | | |
| | | Sulfur-based composition 9 | | | | | | |
| | | Sulfur-based composition 10 | | | | | | |
| | | Sulfur-based composition 11 | | | | | | |
| | | Sulfur-based composition 12 | | | | | | |
| | | Sulfur-based composition 13 | | | | | | |
| Base oil | | Base oil 1 | | Balance | | | Balance | |
| Lubricating oil composition | | | 1,400 | 1,100 | 4,000 | 1,400 | 1,100 | 3,990 |
| Initial friction characteristic | | | | ○○ | | | ○○ | |
| Post-deterioration friction coefficient $\mu_1$ | | | | 0.070 | | | 0.057 | |
| Long-term friction characteristic | | | | ○ | | | ○ | |

| | | | Example 7 | | | Example 8 | | |
|---|---|---|---|---|---|---|---|---|
| | | | Mo content (ppm) Derived from (A) | S content (ppm) Derived from (B) | S content (ppm) Derived from component except (B) | Mo content (ppm) Derived from (A) | S content (ppm) Derived from (B) | S content (ppm) Derived from component except (B) |
| Lubricating oil additive | Molybdenum compound | Molybdenum compound 1 | 1,400 | | 1,540 | 1,100 | | 1,210 |
| | Sulfur-based composition | Sulfur-based composition 1 | | | | | | |
| | | Sulfur-based composition 2 | | | | | | |
| | | Sulfur-based composition 3 | | | | | | |
| | | Sulfur-based composition 4 | | | | | | |
| | | Sulfur-based composition 5 | | | | | | |
| | | Sulfur-based composition 6 | | | | | | |
| | | Sulfur-based composition 7 | | 1,100 | | | | |
| | | Sulfur-based composition 8 | | | | | 1,100 | |
| | | Sulfur-based composition 9 | | | | | | |
| | | Sulfur-based composition 10 | | | | | | |
| | | Sulfur-based composition 11 | | | | | | |

TABLE 3-continued

| | | | | | | | | |
|---|---|---|---|---|---|---|---|---|
| | | Sulfur-based composition 12 | | | | | | |
| | | Sulfur-based composition 13 | | | | | | |
| Base oil | | Base oil 1 | | Balance | | | Balance | |
| Lubricating oil composition | | | 1,400 | 1,100 | 3,990 | 1,100 | 1,100 | 3,760 |
| Initial friction characteristic | | | | ○○ | | | ○○ | |
| Post-deterioration friction coefficient $\mu_1$ | | | | 0.063 | | | 0.072 | |
| Long-term friction characteristic | | | | ○○ | | | ○ | |

TABLE 4

| | | | Example 9 | | | Example 10 | | |
|---|---|---|---|---|---|---|---|---|
| | | | Mo content (ppm) Derived from (A) | S content (ppm) Derived from (B) | S content (ppm) Derived from component except (B) | Mo content (ppm) Derived from (A) | S content (ppm) Derived from (B) | S content (ppm) Derived from component except (B) |
| Lubricating oil additive | Molybdenum compound | Molybdenum compound 1 | 1,400 | | 1,540 | 1,400 | | 1,540 |
| | Sulfur-based composition | Sulfur-based composition 1 | | | | | | |
| | | Sulfur-based composition 2 | | | | | | |
| | | Sulfur-based composition 3 | | | | | | |
| | | Sulfur-based composition 4 | | | | | | |
| | | Sulfur-based composition 5 | | | | | | |
| | | Sulfur-based composition 6 | | | | | | |
| | | Sulfur-based composition 7 | | | | | | |
| | | Sulfur-based composition 8 | | 500 | | | 1,100 | |
| | | Sulfur-based composition 9 | | | | | | |
| | | Sulfur-based composition 10 | | | | | | |
| | | Sulfur-based composition 11 | | | | | | |
| | | Sulfur-based composition 12 | | | | | | |
| | | Sulfur-based composition 13 | | | | | | |
| Base oil | | Base oil 1 | | Balance | | | Balance | |
| Lubricating oil composition | | | 1,400 | 500 | 4,000 | 1,400 | 1,100 | 3,990 |
| Initial friction characteristic | | | | ○○ | | | ○○ | |
| Post-deterioration friction coefficient $\mu_1$ | | | | 0.080 | | | 0.063 | |
| Long-term friction characteristic | | | | ○ | | | ○○ | |

| | | | Example 11 | | | Example 12 | | |
|---|---|---|---|---|---|---|---|---|
| | | | Mo content (ppm) Derived from (A) | S content (ppm) Derived from (B) | S content (ppm) Derived from component except (B) | Mo content (ppm) Derived from (A) | S content (ppm) Derived from (B) | S content (ppm) Derived from component except (B) |
| Lubricating oil additive | Molybdenum compound | Molybdenum compound 1 | 1,400 | | 1,540 | 1,400 | | 1,540 |
| | Sulfur-based composition | Sulfur-based composition 1 | | | | | | |
| | | Sulfur-based composition 2 | | | | | | |

TABLE 4-continued

| | | | | | | | | |
|---|---|---|---|---|---|---|---|---|
| | | Sulfur-based composition 3 | | | | | | |
| | | Sulfur-based composition 4 | | | | | | |
| | | Sulfur-based composition 5 | | | | | | |
| | | Sulfur-based composition 6 | | | | | | |
| | | Sulfur-based composition 7 | | | | | | |
| | | Sulfur-based composition 8 | | | | | | |
| | | Sulfur-based composition 9 | | 1,100 | | | | |
| | | Sulfur-based composition 10 | | | | | 1,100 | |
| | | Sulfur-based composition 11 | | | | | | |
| | | Sulfur-based composition 12 | | | | | | |
| | | Sulfur-based composition 13 | | | | | | |
| Base oil | | Base oil 1 | | Balance | | | Balance | |
| Lubricating oil composition | | | 1,400 | 1,100 | 3,980 | 1,400 | 1,100 | 3,990 |
| Initial friction characteristic | | | | ○○ | | | ○○ | |
| Post-deterioration friction coefficient $\mu_1$ | | | | 0.090 | | | 0.061 | |
| Long-term friction characteristic | | | | ○ | | | ○○ | |

TABLE 5

| | | | Comparative Example 1 | | | Comparative Example 2 |
|---|---|---|---|---|---|---|
| | | | Mo content (ppm) Derived from (A) | S content (ppm) Derived from (B) | S content (ppm) Derived from component except (B) | Mo content (ppm) Derived from (A) |
| Lubricating oil additive | Molybdenum compound | Molybdenum compound 1 | 1,400 | | 1,540 | 1,400 |
| | Sulfur-based composition | Sulfur-based composition 1 | | | | |
| | | Sulfur-based composition 2 | | | | |
| | | Sulfur-based composition 3 | | | | |
| | | Sulfur-based composition 4 | | | | |
| | | Sulfur-based composition 5 | | | | |
| | | Sulfur-based composition 6 | | | | |
| | | Sulfur-based composition 7 | | | | |
| | | Sulfur-based composition 8 | | | | |
| | | Sulfur-based composition 9 | | | | |
| | | Sulfur-based composition 10 | | | | |
| | | Sulfur-based composition 11 | | | 1,100 | |
| | | Sul fur-based composition 12 | | | | |
| | | Sulfur-based composition 13 | | | | |
| Base oil | | Base oil 1 | | Balance | | Balance |
| lubricating oil composition | | | 1,400 | 0 | 5,100 | 1,400 |
| initial friction characteristic | | | | ○○ | | |
| Post-deterioration friction coefficient $\mu_1$ | | | | 0,157 | | |
| Long-term friction characteristic | | | | x | | |

TABLE 5-continued

| | | | Comparative Example 2 | | | Comparative Example 3 | |
|---|---|---|---|---|---|---|---|
| | | | S content (ppm) | | Mo content (ppm) | S content (ppm) | |
| | | | Derived from (B) | Derived from component except (B) | Derived from (A) | Derived from (B) | Derived from component except (B) |
| Lubricating oil additive | Molybdenum compound | Molybdenum compound 1 | | 1,540 | 1,400 | | 1,540 |
| | Sulfur-based composition | Sulfur-based composition 1 | | | | | |
| | | Sulfur-based composition 2 | | | | | |
| | | Sulfur-based composition 3 | | | | | |
| | | Sulfur-based composition 4 | | | | | |
| | | Sulfur-based composition 5 | | | | | |
| | | Sulfur-based composition 6 | | | | | |
| | | Sulfur-based composition 7 | | | | | |
| | | Sulfur-based composition 8 | | | | | |
| | | Sulfur-based composition 9 | | | | | |
| | | Sulfur-based composition 10 | | | | | |
| | | Sulfur-based composition 11 | | | | | |
| | | Sul fur-based composition 12 | | 1,100 | | | |
| | | Sulfur-based composition 13 | | | | | 1,100 |
| Base oil | | Base oil 1 | Balance | | | Balance | |
| lubricating oil composition | | | 0 | 5,100 | 1,400 | 0 | 5,100 |
| initial friction characteristic | | | ○○ | | | ○○ | |
| Post-deterioration friction coefficient $\mu_1$ | | | 0.157 | | | 0.171 | |
| Long-term friction characteristic | | | x | | | x | |

TABLE 6

| | | | Comparative Example 4 | | | Comparative Example 5 | | |
|---|---|---|---|---|---|---|---|---|
| | | | Mo content (ppm) | S content (ppm) | | Mo content (ppm) | S content (ppm) | |
| | | | Derived from (A) | Derived from (B) | Derived from component except (B) | Derived from (A) | Derived from (B) | Derived from component except (B) |
| Lubricating oil additive | Molybdenum compound | Molybdenum compound 1 | 700 | | 770 | 1,400 | | 1,540 |
| | Sulfur-based composition | Sulfur-based composition 1 | | | | | | |
| | | Sulfur-based composition 2 | | | | | | |
| | | Sulfur-based composition 3 | | | | | | |
| | | Sulfur-based composition 4 | | | | | | |
| | | Sulfur-based composition 5 | | | | | | |

TABLE 6-continued

| | | Comparative Example 4 | | | Comparative Example 5 | | |
|---|---|---|---|---|---|---|---|
| | | Mo content (ppm) Derived from (A) | S content (ppm) Derived from (B) | S content (ppm) Derived from component except (B) | Mo content (ppm) Derived from (A) | S content (ppm) Derived from (B) | S content (ppm) Derived from component except (B) |
| | Sulfur-based composition 6 | | | | | | |
| | Sulfur-based composition 7 | | | | | | |
| | Sulfur-based composition 8 | | | | | | |
| | Sulfur-based composition 9 | | | | | | |
| | Sulfur-based composition 10 | | | | | | |
| | Sulfur-based composition 11 | | | | | | |
| | Sulfur-based composition 12 | | | | | | |
| | Sulfur-based composition 13 | | | | | | |
| Base oil | Base oil 1 | | Balance | | | Balance | |
| Lubricating oil composition | | 700 | 0 | 3,250 | 1,400 | 0 | 4,010 |
| Initial friction characteristic | | | ○○ | | | ○○ | |
| Post-deterioration friction coefficient $\mu_1$ | | | 0.179 | | | 0.161 | |
| Long-term friction characteristic | | | x | | | x | |

<Measurement of Initial Friction Coefficient and Evaluation of Initial Friction Characteristic>

The initial friction coefficient $\mu_0$ of each of the produced lubricating oil compositions was measured with an SRV measurement tester (manufactured by Optimol Instruments Pruftechnik GmbH, model: type 3) by a cylinder-on-plate wire contact method under the following conditions, and the initial friction characteristic thereof was evaluated by the following criteria. The evaluation results are shown in Tables 2 to 6.

Load: 200 N

Temperature: 80° C.

Measurement time: 15 minutes (friction coefficient after a lapse of 15 minutes was used)

Amplitude: 1 mm

Upper cylinder: φ15×22 mm (material: SUJ-2)

Lower plate: φ24×6.85 mm (material: SUJ-2)

Criteria for Evaluation of Initial Friction Characteristic

○○: $\mu_0 \leq 0.070$

○: $0.070 < \mu_0 \leq 0.090$ x: $0.090 < \mu_0$

<Measurement of Post-Deterioration Friction Coefficient and Evaluation of Long-Term Friction Characteristic (1)>

90 Grams of each of the produced lubricating oil compositions was loaded into a 200-milliliter flask made of glass, and under a state in which the flask was placed in a thermostat at 80° C., an oxygen gas and a nitrogen gas containing 8,000 ppm of nitrogen monoxide were blown at flow rates of 115 ml/min and 10 ml/min, respectively into the flask for 72 hours. Thus, a lubricating oil composition subjected to deterioration treatment was obtained. The deterioration treatment corresponds to a travel of about ten thousand kilometers when the composition is used as an engine oil. The post-deterioration friction coefficient $\mu_1$ of the lubricating oil composition subjected to the deterioration treatment was measured by the same measurement method as that in the measurement of the initial friction coefficient. In addition, the long-term friction characteristic of the composition was evaluated on the basis of the measured post-deterioration friction coefficient $\mu_1$ in accordance with the following criteria. The measurement results and the evaluation results are shown in Tables 2 to 6.

Criteria 1 for Evaluation of Long-Term Friction Characteristic

○○: $\mu_1 \leq 0.070$

○: $0.070 < \mu_1 \leq 0.090$ x: $0.090 < \mu_1$

<Preparation of Lubricating Oil Additive and Lubricating Oil Composition (2)>

A lubricating oil composition (Example 13) comprising each of a lubricating oil additive consisting of the molybdenum compound and the prepared sulfur-based composition, and the base oil in a blending amount shown in Table 7 was produced. In addition, as a comparative example, a lubricating oil composition (Comparative Example 6) free of any sulfur-based composition was also produced. The blending amounts of the molybdenum compound in the respective lubricating oil compositions are each represented by a molybdenum element content (ppm by mass) (Mo content (ppm)), and the blending amount of the sulfur-based composition in the composition of Example 13 is represented by a sulfur element content (ppm by mass) (S content (ppm)).

TABLE 7

| | | | Example 13 | | | Comparative Example 6 | | |
|---|---|---|---|---|---|---|---|---|
| | | | Mo content (ppm) Derived from (A) | S content (ppm) Derived from (B) | S content (ppm) Derived from component except (B) | Mo content (ppm) Derived from (A) | S content (ppm) Derived from (B) | S content (ppm) Derived from component except (B) |
| Lubricating oil additive | Molybdenum compound | Molybdenum compound 1 | 700 | | 770 | 700 | | 770 |
| | Sulfur-based composition | Sulfur-based composition 8 | | 500 | | | | |
| | Base oil | Base oil 1 | | Balance | | | Balance | |
| Lubricating oil composition | | | 700 | 500 | 3,230 | 700 | 0 | 3,250 |
| Initial friction characteristic | | | | ○○ | | | ○○ | |
| Post-deterioration friction coefficient $\mu_2$ | | | | 0.083 | | | 0.168 | |
| Long-term friction characteristic | | | | ○ | | | x | |

<Measurement of Post-Deterioration Friction Coefficient and Evaluation of Long-Term Friction Characteristic (2)>

A post-deterioration friction coefficient $\mu_2$ was measured by the same method as that in the measurement of the post-deterioration friction coefficient described above except that a lubricating oil composition subjected to deterioration treatment was produced while the time period for which the nitrogen gas was blown into the flask was set to 48 hours. The deterioration treatment corresponds to a travel of about 7,000 kilometers when the composition is used as an engine oil. In addition, the long-term friction characteristic of the composition was evaluated on the basis of the measured post-deterioration friction coefficient $\mu_2$ in accordance with the following criteria. The measurement results and the evaluation results are shown in Table 7.

Criteria 2 for Evaluation of Long-Term Friction Characteristic

○○: $\mu_2 \leq 0.070$

○: $0.070 < \mu_2 \leq 0.090$ x: $0.090 < \mu_2$

It was shown that each of the products of the present invention was excellent in initial friction characteristic and long-term friction characteristic. Accordingly, the lubricating oil additive of the present invention can exhibit an excellent friction characteristic over a long time period from the initial stage of its use, and the addition of the additive to a base oil can provide a lubricating oil composition capable of, for example, improving fuel efficiency over a long time period.

The invention claimed is:

1. A lubricating oil additive, comprising:

a molybdenum compound (A) represented by the following general formula (1); and a sulfur-based composition (B) containing a sulfur-based compound (b-1) represented by the following general formula (2) and at least one kind of sulfur-based compound (b-2) represented by the following general formula (3) or (4), wherein a mass ratio "b-1:b-2" between contents of the sulfur-based compound (b-1) and the sulfur-based compound (b-2) in the sulfur-based composition (B) is from 0.5:99.5 to 95:5:

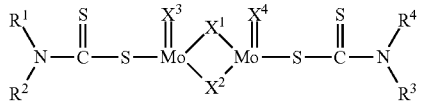

(1)

where $R^1$ to $R^4$ each represent linear or branched alkyl groups having 8 or 13 carbon atoms, the groups being identical to or different from each other, and $X^1$ to $X^4$ each independently represent an oxygen atom or a sulfur atom;

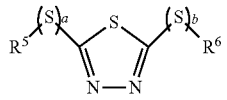

(2)

where $R^5$ and $R^6$ each represent alkyl groups having 3 to 24 carbon atoms, the groups being identical to or different from each other, and "a" and "b" each represent a number from 1 to 5;

$$HOOC-R^7-(S)_c-R^8-COOH \quad (3)$$

$$R^{11}OOC-R^9-(S)_d-R^{10}-COOR^{12} \quad (4)$$

where $R^7$ to $R^{10}$ each represent alkylene groups having 1 to 28 carbon atoms, the groups being identical to or different from each other, $R^{11}$ and $R^{12}$ each independently represent a hydrogen atom or an alkyl group having 1 to 3 carbon atoms, "c" and "d" each independently represent a number from 1 to 5, and averages of "c" and "d" each are from 2.5 to 3.5, provided that at least one of $R^{11}$ or $R^{12}$ represents an alkyl group having 1 to 3 carbon atoms.

2. The lubricating oil additive according to claim 1, wherein the sulfur-based composition (B) has a sulfur element ratio of from 5 mass % to 50 mass %.

3. The lubricating oil additive according to claim 1, wherein a mass ratio "Mo:S" between a content of a molybdenum element derived from the molybdenum compound (A) and a content of a sulfur element derived from the sulfur-based composition (B) is from 20:80 to 80:20.

4. The lubricating oil additive according to claim 1, wherein the sulfur-based compound (b-1) contains a compound represented by the general formula (2) in which $R^5$ and $R^6$ each represent alkyl groups having 6 to 14 carbon atoms, the groups being identical to or different from each other.

5. The lubricating oil additive according to claim 1, wherein the sulfur-based compound (b-2) contains a compound represented by the general formula (3) in which $R^7$ and $R^8$ each represent alkylene groups having 6 to 24 carbon atoms, the groups being identical to or different from each other, or a compound represented by the general formula (4) in which $R^9$ and $R^{10}$ each represent alkylene groups having 6 to 24 carbon atoms, the groups being identical to or different from each other.

6. A lubricating oil composition, comprising:

a base oil;

a molybdenum compound (A) represented by the following general formula (1); and a sulfur-based composition (B) containing a sulfur-based compound (b-1) represented by the following general formula (2) and at least one kind of sulfur-based compound (b-2) represented by the following general formula (3) or (4), wherein a mass ratio "b-1:b-2" between contents of the sulfur-based compound (b-1) and the sulfur-based compound (b-2) in the sulfur-based composition (B) is from 0.5:99.5 to 95:5:

(1)

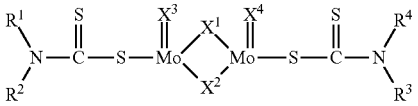

where $R^1$ to $R^4$ each represent linear or branched alkyl groups having 8 or 13 carbon atoms, the groups being identical to or different from each other, and $X^1$ to $X^4$ each independently represent an oxygen atom or a sulfur atom;

(2)

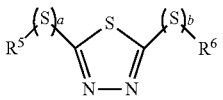

where $R^5$ and $R^6$ each represent alkyl groups having 3 to 24 carbon atoms, the groups being identical to or different from each other, and "a" and "b" each represent a number from 1 to 5;

(3)

$$HOOC—R^7—(S)_c—R^8—COOH$$

(4)

$$R^{11}OOC—R^9—(S)_d—R^{10}—COOR^{12}$$

where $R^7$ to $R^{10}$ each represent alkylene groups having 1 to 28 carbon atoms, the groups being identical to or different from each other, $R^{11}$ and $R^{12}$ each independently represent a hydrogen atom or an alkyl group having 1 to 3 carbon atoms, "c" and "d" each independently represent a number from 1 to 5, and averages of "c" and "d" each are from 2.5 to 3.5, provided that at least one of $R^{11}$ or $R^{12}$ represents an alkyl group having 1 to 3 carbon atoms.

7. The lubricating oil composition according to claim 6, wherein a content of a molybdenum element in the lubricating oil composition is from 200 ppm by mass to 2,000 ppm by mass, and a content of a sulfur element therein is from 500 ppm by mass to 8,000 ppm by mass.

8. A method of sustaining a friction-reducing effect of a molybdenum compound (A) represented by the following general formula (1), comprising adding a sulfur-based composition (B) to a lubricating oil composition comprising a base oil and the molybdenum compound (A), wherein the sulfur-based composition (B) contains a sulfur-based compound (b-1) represented by the following general formula (2) and at least one kind of sulfur-based compound (b-2) represented by the following general formula (3) or (4), wherein a mass ratio "b-1:b-2" between contents of the sulfur-based compound (b-1) and the sulfur-based compound (b-2) in the sulfur-based composition (B) is from 0.5:99.5 to 95:5:

(1)

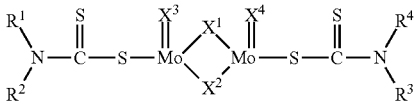

where $R^1$ to $R^4$ each represent linear or branched alkyl groups having 8 or 13 carbon atoms, the groups being identical to or different from each other, and $X^1$ to $X^4$ each independently represent an oxygen atom or a sulfur atom;

(2)

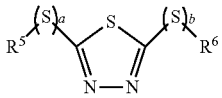

where $R^5$ and $R^6$ each represent alkyl groups having 3 to 24 carbon atoms, the groups being identical to or different from each other, and "a" and "b" each represent a number from 1 to 5;

(3)

$$HOOC—R^7—(S)_c—R^8—COOH$$

(4)

$$R^{11}OOC—R^9—(S)_d—R^{10}—COOR^{12}$$

where $R^7$ to $R^{10}$ each represent alkylene groups having 1 to 28 carbon atoms, the groups being identical to or different from each other, $R^{11}$ and $R^{12}$ each independently represent a hydrogen atom or an alkyl group having 1 to 3 carbon atoms, "c" and "d" each independently represent a number from 1 to 5, and averages of "c" and "d" each are from 2.5 to 3.5, provided that at least one of $R^{11}$ or $R^{12}$ represents an alkyl group having 1 to 3 carbon atoms.

* * * * *